US011084626B2

(12) United States Patent
Gilpatrick et al.

(10) Patent No.: US 11,084,626 B2
(45) Date of Patent: Aug. 10, 2021

(54) METHOD OF FORMING A CONTAINER

(71) Applicant: Graphic Packaging International, Inc., Atlanta, GA (US)

(72) Inventors: William Gilpatrick, Broomfield, CO (US); Jeffrey T. Sloat, Broomfield, CO (US)

(73) Assignee: Graphic Packaging International, LLC, Atlanta, GA (US)

( * ) Notice: Subject to any disclaimer, the term of this patent is extended or adjusted under 35 U.S.C. 154(b) by 307 days.

(21) Appl. No.: 15/696,795

(22) Filed: Sep. 6, 2017

(65) Prior Publication Data

US 2017/0361988 A1 Dec. 21, 2017

Related U.S. Application Data

(62) Division of application No. 15/053,151, filed on Feb. 25, 2016, now abandoned.

(Continued)

(51) Int. Cl.
*B65D 25/14* (2006.01)
*B65D 81/34* (2006.01)

(Continued)

(52) U.S. Cl.
CPC ..... *B65D 25/14* (2013.01); *B65D 1/34* (2013.01); *B65D 77/20* (2013.01);

(Continued)

(58) Field of Classification Search
USPC ..... 493/52
See application file for complete search history.

(56) References Cited

U.S. PATENT DOCUMENTS 1,022,882 A 4/1912 Schwenn
2,328,563 A 9/1943 Lichter (Continued)

FOREIGN PATENT DOCUMENTS

DE 509 065 4/1969
DE 80 11 020 9/1980

(Continued)

OTHER PUBLICATIONS

Supplementary European Search Report for EP 16 75 6325 dated Jul. 5, 2018.

(Continued)

*Primary Examiner* — Anna K Kinsaul
*Assistant Examiner* — Chinyere J Rushing-Tucker
(74) *Attorney, Agent, or Firm* — Womble Bond Dickinson (US) LLP

(57) ABSTRACT

A method of forming a container from a blank. The method can comprise obtaining a blank having a wall portion, a flange portion, and a coating on at least a portion of the flange portion. At least one score line can extend at least partially in the flange portion, and the coating can at least partially cover the at least one score line. The method further can comprise forming the container from the blank by forming a wall of the container from the wall portion and forming a flange of the container from the flange portion. The flange can extend from the wall. The forming the container further can comprise forming the at least one score line into at least one pleat in at least the flange. The coating can at least partially cover the at least one pleat to form a substantially continuous sealing surface on the flange.

23 Claims, 8 Drawing Sheets

Related U.S. Application Data

(60) Provisional application No. 62/121,680, filed on Feb. 27, 2015.

(51) Int. Cl.
*B65D 77/20* (2006.01)
*B65D 1/34* (2006.01)

(52) U.S. Cl.
CPC .. *B65D 81/3453* (2013.01); *B65D 2581/3466* (2013.01); *B65D 2581/3472* (2013.01); *B65D 2581/3474* (2013.01); *B65D 2581/3477* (2013.01); *B65D 2581/3478* (2013.01); *B65D 2581/3479* (2013.01); *B65D 2581/3489* (2013.01); *B65D 2581/3494* (2013.01)

(56) References Cited

U.S. PATENT DOCUMENTS 2,522,397 A 9/1950 Palmer
2,607,080 A 8/1952 Stewart
2,634,880 A 4/1953 Gravatt
2,937,949 A 5/1960 Loevenbruck
2,997,927 A 8/1961 Carson
3,033,434 A 5/1962 Carson
3,040,949 A 6/1962 Foote
3,099,377 A 7/1963 Metzler et al.
3,119,540 A 1/1964 Scenk et al.
3,135,455 A 6/1964 Santangelo
3,144,167 A 8/1964 Schultz
3,154,617 A 10/1964 Schenk et al.
3,190,530 A 6/1965 Edwards
3,195,770 A 7/1965 Robertson
3,220,631 A 11/1965 Reifers
3,226,008 A 12/1965 Chiorri
3,229,886 A 1/1966 Grogel
3,286,876 A 11/1966 Ring
3,315,018 A 4/1967 Commeyras
3,511,902 A 5/1970 Santangelo
3,530,917 A 9/1970 Donavan
3,669,305 A 6/1972 Kinney et al.
3,680,733 A 8/1972 Winslow
3,684,633 A 8/1972 Haase
3,720,365 A 3/1973 Unger
3,765,976 A 10/1973 Nasica
3,785,544 A 1/1974 Smith
3,834,606 A 9/1974 Andersson
3,850,340 A 11/1974 Siemonsen et al.
3,941,301 A 3/1976 Jorgensen
3,967,731 A 7/1976 Boduch
3,968,921 A 7/1976 Jewell
3,973,689 A 8/1976 Sutch
4,001,471 A 1/1977 Runnball
4,026,458 A * 5/1977 Morris ..... B31F 1/0077 229/182.1
4,051,707 A 10/1977 Valek et al.
4,079,851 A 3/1978 Valyi
4,096,947 A 6/1978 Morse
4,113,095 A 9/1978 Dietz et al.
4,123,214 A 10/1978 Sutch
4,139,115 A 2/1979 Robinson
4,149,838 A 4/1979 Sutch
4,183,435 A 1/1980 Thompson et al.
4,202,464 A 5/1980 Mohs et al.
4,283,427 A 8/1981 Winters et al.
4,284,023 A 8/1981 Murayama
4,312,451 A 1/1982 Forbes, Jr.
4,404,162 A 9/1983 Miki et al.
4,473,165 A 9/1984 Lentjes
4,489,120 A 12/1984 Hollinger, Jr.
4,533,065 A 8/1985 Chazal et al.
4,533,312 A 8/1985 Von Holdt
4,606,496 A 8/1986 Marx et al.
4,609,140 A 9/1986 Van Handel et al.
4,624,380 A 11/1986 Wernette
4,641,005 A * 2/1987 Seiferth ..... A47J 36/022 156/233
4,704,510 A 11/1987 Matsui
4,721,499 A 1/1988 Marx et al.
4,721,500 A 1/1988 Van Handel et al.
4,775,771 A 10/1988 Pawlowski et al.
4,825,025 A * 4/1989 Seiferth ..... A47J 36/022 219/730
4,832,676 A 5/1989 Johns et al.
4,865,921 A 9/1989 Hollenberg et al.
4,890,439 A 1/1990 Smart et al.
4,935,089 A 6/1990 Schirmer
4,936,935 A 6/1990 Beckett
4,943,456 A 7/1990 Pollart et al.
4,963,424 A 10/1990 Beckett
4,967,908 A 11/1990 Kessler
4,971,201 A 11/1990 Sathre
5,002,826 A 3/1991 Pollart et al.
5,039,364 A 8/1991 Beckett et al.
5,117,078 A 5/1992 Beckett
5,118,747 A 6/1992 Pollart et al.
5,183,706 A 2/1993 Bekele
5,190,209 A 3/1993 Gordon et al.
5,213,902 A 5/1993 Beckett
5,219,461 A 6/1993 Hyll et al.
5,221,419 A 6/1993 Beckett
5,260,537 A 11/1993 Beckett
5,266,386 A 11/1993 Beckett
5,269,717 A 12/1993 Tardif
5,310,980 A * 5/1994 Beckett ..... A47J 36/04 219/709
RE34,683 E 8/1994 Maynard et al.
5,335,787 A 8/1994 Finchum
5,335,847 A 8/1994 Lisiecki
5,340,436 A 8/1994 Beckett
5,354,973 A 10/1994 Beckett
5,410,135 A 4/1995 Pollart et al.
5,412,187 A 5/1995 Walters et al.
5,424,517 A 6/1995 Habeger, Jr. et al.
5,506,036 A 4/1996 Bergerious
5,519,195 A 5/1996 Keefer et al.
5,530,231 A 6/1996 Walters et al.
5,565,228 A 10/1996 Gics
5,617,972 A 4/1997 Morano et al.
5,628,921 A 5/1997 Beckett
5,672,407 A 9/1997 Beckett
5,676,276 A * 10/1997 Zielinski ..... A47G 23/06 206/557
5,758,773 A 6/1998 Clements
5,759,422 A 6/1998 Schmelzer et al.
5,782,376 A 7/1998 Brauner et al.
5,800,724 A 9/1998 Habeger et al.
5,934,472 A 8/1999 Ramirez et al.
5,938,112 A 8/1999 Sandstrom
6,093,460 A * 7/2000 Iwaya ..... B31F 1/0087 156/224
6,114,679 A 9/2000 Lai et al.
6,149,006 A 11/2000 Brauner et al.
6,150,646 A 11/2000 Lai et al.
6,204,492 B1 3/2001 Zeng et al.
6,213,301 B1 4/2001 Landis et al.
6,237,845 B1 5/2001 Hashimoto et al.
6,251,451 B1 6/2001 Zeng
6,308,831 B1 10/2001 Saxe et al.
6,325,213 B1 12/2001 Landis, II
6,414,290 B1 7/2002 Cole et al.
6,415,945 B1 7/2002 Zank et al.
6,433,322 B2 8/2002 Zeng et al.
6,455,827 B2 9/2002 Zeng
6,547,127 B2 4/2003 Bradford et al.
6,552,315 B2 4/2003 Zeng et al.
6,568,534 B2 5/2003 Zank
6,667,004 B2 12/2003 Cha
6,677,563 B2 1/2004 Lai
6,682,675 B1 1/2004 Vandangeot et al.
6,682,676 B1 1/2004 Renault et al.
6,717,121 B2 4/2004 Zeng et al.
6,765,182 B2 7/2004 Cole et al.
6,790,026 B2 9/2004 Vandangeot et al.

(56) References Cited

U.S. PATENT DOCUMENTS

| | | | | |
|---|---|---|---|---|
| 6,823,624 | B2 | 11/2004 | Proserpio | |
| 6,981,863 | B2 | 1/2006 | Renault et al. | |
| 6,988,654 | B2 | 1/2006 | Wnek | |
| 7,000,825 | B2 | 2/2006 | Alexander et al. | |
| 7,019,271 | B2 | 3/2006 | Wnek et al. | |
| 7,311,868 | B2 | 12/2007 | Ek | |
| 7,323,669 | B2 | 1/2008 | Robison et al. | |
| 7,337,943 | B2 | 3/2008 | Johns et al. | |
| 7,351,942 | B2 | 4/2008 | Wnek et al. | |
| 7,365,292 | B2 | 4/2008 | Cole et al. | |
| 7,476,830 | B2 | 1/2009 | Middleton et al. | |
| 7,541,562 | B2 | 6/2009 | Cole et al. | |
| 8,252,217 | B2 | 8/2012 | Wnek et al. | |
| 8,464,871 | B2 | 6/2013 | Wnek | |
| 8,464,894 | B2 | 6/2013 | O'Hagan et al. | |
| 8,480,551 | B2 | 7/2013 | Wnek | |
| 8,777,010 | B2 | 7/2014 | Wnek | |
| 8,784,959 | B2 | 7/2014 | O'Hagan et al. | |
| 8,858,858 | B2 | 10/2014 | Middleton et al. | |
| 9,016,497 | B2 | 4/2015 | Karhu et al. | |
| 9,132,612 | B2 | 9/2015 | Bohrer | |
| 9,315,292 | B2 | 4/2016 | Wnek et al. | |
| 2001/0004003 | A1 | 6/2001 | Watanabe et al. | |
| 2002/0092791 | A1 | 7/2002 | Wnek | |
| 2002/0113118 | A1 | 8/2002 | Littlejohn et al. | |
| 2003/0004003 | A1 | 1/2003 | Lochtefeld | |
| 2003/0014912 | A1 | 1/2003 | Proserpio | |
| 2003/0205319 | A1 | 11/2003 | Bengtsson et al. | |
| 2004/0239005 | A1 | 12/2004 | Ek et al. | |
| 2004/0262322 | A1* | 12/2004 | Middleton | B29C 45/14336 220/675 |
| 2005/0109653 | A1* | 5/2005 | Wnek | B65D 1/34 206/515 |
| 2005/0273064 | A1* | 12/2005 | Dircks | B32B 7/12 604/322 |
| 2006/0198972 | A1 | 9/2006 | Ueda et al. | |
| 2007/0081743 | A1 | 4/2007 | Kim | |
| 2007/0194029 | A1 | 8/2007 | Middleton et al. | |
| 2007/0235514 | A1 | 10/2007 | Abayhan et al. | |
| 2007/0251943 | A1 | 11/2007 | Wnek et al. | |
| 2007/0253314 | A1 | 11/2007 | Jones et al. | |
| 2007/0262487 | A1* | 11/2007 | O'Hagan | B29C 51/082 264/241 |
| 2007/0267374 | A1* | 11/2007 | Middleton | B29C 45/14336 211/126.1 |
| 2008/0000896 | A1 | 1/2008 | Lafferty et al. | |
| 2008/0035634 | A1 | 2/2008 | Zeng et al. | |
| 2008/0073339 | A1 | 3/2008 | Lamarche | |
| 2008/0164178 | A1 | 7/2008 | Wnek et al. | |
| 2009/0152333 | A1* | 6/2009 | Maeaettae | B29C 43/203 229/104 |
| 2009/0173776 | A1 | 7/2009 | Swoboda et al. | |
| 2009/0223952 | A1 | 9/2009 | Wnek et al. | |
| 2009/0250372 | A1* | 10/2009 | Wnek | B29C 45/0046 206/557 |
| 2010/0308064 | A1* | 12/2010 | O'Hagan | B29C 45/0046 220/677 |
| 2011/0062050 | A1* | 3/2011 | Wnek | B65D 1/34 206/557 |
| 2011/0065556 | A1* | 3/2011 | Middleton | B29C 45/14336 493/52 |
| 2011/0272318 | A1 | 11/2011 | Gallop et al. | |
| 2012/0292813 | A1* | 11/2012 | Middleton | B65D 81/3453 264/255 |
| 2013/0260106 | A1* | 10/2013 | Bohrer | B32B 23/046 428/192 |
| 2014/0103038 | A1* | 4/2014 | Wnek | B65D 1/28 220/62 |
| 2015/0375468 | A1* | 12/2015 | Wnek | B65D 1/34 493/162 |
| 2018/0022529 | A1* | 1/2018 | Tye | B65D 5/563 206/557 |

FOREIGN PATENT DOCUMENTS

| | | | |
|---|---|---|---|
| DE | 87 13 290.7 | | 1/1988 |
| DE | 37 37 052 | | 5/1989 |
| DE | 296 02 348 | | 5/1996 |
| DE | 101 49 143 | | 4/2003 |
| EP | 0 082 209 | | 6/1983 |
| EP | 0 156 000 | | 10/1985 |
| EP | 0 816 239 | | 1/1998 |
| EP | 0 844 972 | | 7/2002 |
| EP | 1 332 972 | | 8/2003 |
| EP | 3 150 502 | A1 | 4/2017 |
| FR | 1 006 970 | | 4/1952 |
| FR | 1 288 503 | | 3/1962 |
| FR | 2 266 638 | | 10/1975 |
| FR | 2 599 002 | | 11/1987 |
| FR | 2 677 915 | | 12/1992 |
| FR | 2 733 715 | | 11/1996 |
| FR | 2 806 346 | | 9/2001 |
| FR | 2 806 347 | | 9/2001 |
| GB | 1 264 484 | | 2/1972 |
| GB | 1 348 370 | | 3/1974 |
| GB | 1 376 603 | | 12/1974 |
| GB | 1 487 825 | | 10/1977 |
| GB | 1 502 266 | | 3/1978 |
| GB | 2 075 462 | | 11/1981 |
| GB | 2 171 048 | | 8/1986 |
| JP | 47 23456 | | 10/1972 |
| JP | 53-8574 | | 3/1978 |
| JP | 54-116059 | | 9/1979 |
| JP | 54-126887 | | 10/1979 |
| JP | 56-065866 | | 6/1981 |
| JP | 57-8651 | | 1/1982 |
| JP | 59-075004 | | 4/1984 |
| JP | 60-96234 | | 7/1985 |
| JP | 3-4582 | | 1/1991 |
| JP | 3004582 | | 1/1991 |
| JP | 3057020 | | 5/1991 |
| JP | 5-42928 | | 2/1993 |
| JP | 6-000843 | | 1/1994 |
| JP | 7-28833 | | 5/1995 |
| JP | 08-119271 | | 5/1996 |
| JP | 08-156944 | | 6/1996 |
| JP | 3031361 | | 9/1996 |
| JP | 08-282647 | | 10/1996 |
| JP | 8-337234 | | 12/1996 |
| JP | 08-337235 | | 12/1996 |
| JP | 09-254948 | | 9/1997 |
| JP | 2000-043840 | | 2/2000 |
| JP | 2001-213420 | | 2/2000 |
| JP | 2000-142825 | | 5/2000 |
| JP | 2000-238760 | | 9/2000 |
| JP | 2000-309326 | | 11/2000 |
| JP | 2000-335550 | | 12/2000 |
| JP | 2000-517260 | | 12/2000 |
| JP | 2001-328617 | | 11/2001 |
| JP | 2002 225156 | A | 8/2002 |
| JP | 2006-513108 | | 4/2006 |
| JP | 2007-510598 | | 4/2007 |
| JP | 2007-111888 | | 5/2007 |
| KR | 1999-023720 | | 7/1999 |
| KR | 10-0360299 | | 11/2002 |
| KR | 20-0318533 | | 6/2003 |
| WO | WO 94/01276 | | 1/1994 |
| WO | WO 94/08777 | | 4/1994 |
| WO | WO 96/11142 | | 4/1996 |
| WO | WO 96/27532 | | 9/1996 |
| WO | WO 98/09812 | | 3/1998 |
| WO | WO 03/066435 | | 8/2003 |
| WO | WO 03/078012 | | 9/2003 |
| WO | WO 2004/033324 | | 4/2004 |
| WO | WO 2005/047126 | | 5/2005 |
| WO | WO 2007/106367 | | 9/2007 |
| WO | WO 2007/127371 | | 11/2007 |
| WO | WO 2008/049048 | | 4/2008 |
| WO | WO 2009/058807 | | 5/2009 |

(56) References Cited

FOREIGN PATENT DOCUMENTS

| | | |
|---|---|---|
| WO | WO 2009/086501 | 7/2009 |
| WO | WO 2009/088904 | 7/2009 |

OTHER PUBLICATIONS

International Search Report and Written Opinion for PCT/US2016/019467 dated May 30, 2016.
English translation of Japanese Publication No. P2001-328617.
Office Action for U.S. Appl. No. 15/053,151 dated Feb. 7, 2017.
Response to Restriction Requirement for U.S. Appl. No. 15/053,151 dated Mar. 20, 2017.
Office Action for U.S. Appl. No. 15/053,151 dated Apr. 13, 2017.
Amendment A and Response to Office Action for U.S. Appl. No. 15/053,151 dated Jun. 1, 2017.
Office Action for U.S. Appl. No. 15/053,151 dated Jul. 10, 2017.
Request for Continued Examination (RCE) Transmittal for U.S. Appl. No. 15/053,151 dated Aug. 18, 2017.
Amendment B and Response to Final Office Action for U.S. Appl. No. 15/053,151 dated Aug. 18, 2017.
Office Action for U.S. Appl. No. 15/053,151 dated Sep. 11, 2017.

* cited by examiner

METHOD OF FORMING A CONTAINER

CROSS-REFERENCED TO RELATED APPLICATIONS

This application is a divisional application of U.S. patent application Ser. No. 15/053,151, filed on Feb. 25, 2016, which claims the benefit of U.S. Provisional Patent Application No. 62/121,680, filed on Feb. 27, 2015.

INCORPORATION BY REFERENCE

The disclosures of U.S. patent application Ser. No. 15/053,151, which was filed on Feb. 25, 2016, U.S. Provisional Patent Application No. 62/121,680, which was filed on Feb. 27, 2015, are hereby incorporated by reference for all purposes as if presented herein in their entirety.

BACKGROUND OF THE DISCLOSURE

The present disclosure relates to blanks, containers, trays, constructs, and various features to facilitate forming a container from a blank.

SUMMARY OF THE DISCLOSURE

In one aspect, the disclosure is generally directed to a container for holding an article. The container can comprise a wall and a flange extending from the wall. The wall can at least partially define a cavity of the container. At least one pleat can extend in at least the flange, and a coating can be on at least a portion of the flange. The coating can at least partially cover the at least one pleat and can form a substantially continuous sealing surface on the flange.

In another aspect, the disclosure is generally directed to a blank for forming a container for holding an article. The blank can comprise a wall portion and a flange portion for forming a respective wall and flange of a container formed from the blank. At least one score line can be for forming at least one pleat extending in at least the flange when the blank is formed into the container. The at least one score line can extend in at least the flange portion. A coating can be on at least a portion of the flange portion. The coating can be at least partially covering the at least one score line and can form a substantially continuous sealing surface on the flange in the container formed from the blank.

In another aspect, the disclosure is generally directed to a method of forming a container from a blank. The method can comprise obtaining a blank having a wall portion, a flange portion, and a coating on at least a portion of the flange portion. At least one score line can extend at least partially in the flange portion, and the coating can at least partially cover the at least one score line. The method further can comprise forming the container from the blank by forming a wall of the container from the wall portion and forming a flange of the container from the flange portion. The flange can extend from the wall. The forming the container further can comprise forming the at least one score line into at least one pleat in at least the flange. The coating can at least partially cover the at least one pleat to form a substantially continuous sealing surface of the container on the flange.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure relates generally to various aspects of containers, constructs, trays, materials, packages, elements, and articles, and methods of making such containers, constructs, trays, materials, packages, elements, and articles. Although several different aspects, implementations, and embodiments are disclosed, numerous interrelationships between, combinations thereof, and modifications of the various aspects, implementations, and embodiments are contemplated hereby. In one illustrated embodiment, the present disclosure relates to forming a container or tray for holding food items or various other articles. However, in other embodiments, the container or tray can be used to form other non-food containing articles or may be used for heating or cooking.

Figure 1:
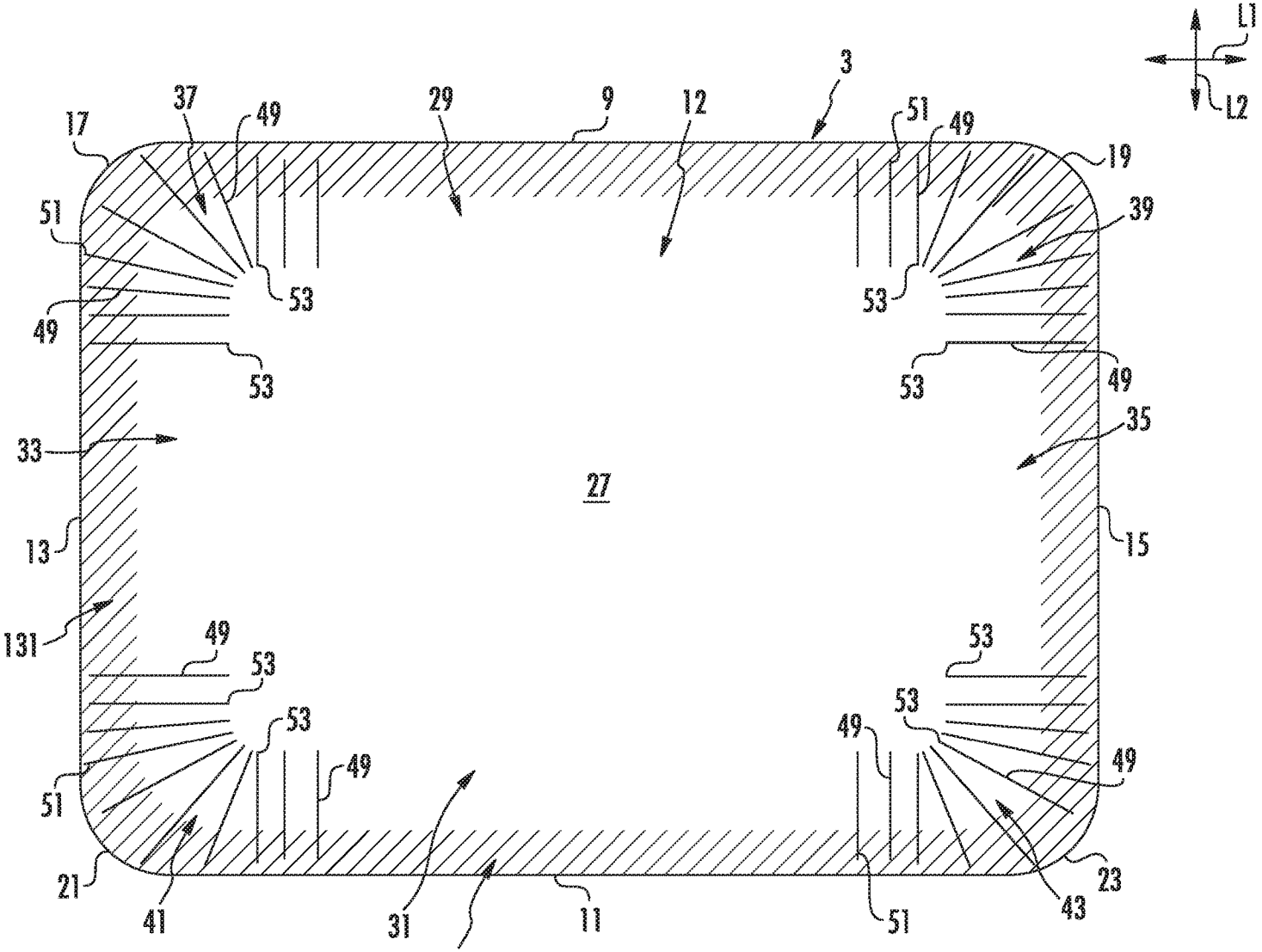
FIG. 1 is a plan view of a blank used for forming a container according to a first embodiment of the disclosure.

FIG. 1 illustrates a blank 3 that is used to form a container 5 (FIGS. 2-5) having a flange 7 according to a first embodiment of the disclosure. In the illustrated embodiment, the blank 3 is generally rectangular and has generally straight side edges 9, 11 and straight end edges 13, 15 with rounded corners 17, 19, 21, 23 extending between respective side edges and end edges. The blank 3 is for being press formed into the container 5 that, in the illustrated embodiment, is a generally rectangular tray. It is understood that the blank 3 can be press-formed into the container 5 by a forming tool T (shown schematically in FIGS. 8 and 9 by way of example), which can be similar to and have similar features and/or components as conventional forming tools such as are disclosed in U.S. Pat. No. 8,534,460, the entire contents of which are incorporated herein by reference for all purposes. Also, the forming tool can have similar features and components such as the forming tool disclosed in U.S. Pat.

No. 8,801,995, the entire contents of which are incorporated by reference for all purposes, or any other suitable forming tool assembly. The blank 3 and the container 5 could be alternatively shaped (e.g., circular, oval, rectangular, annular, irregular, etc.) and/or any suitable forming tool could be used to form the container 5 from the blank 3 without departing from the scope of this disclosure.

The blank 3 can be formed from a single ply of material, such as but not limited to paperboard, cardboard, paper, or a polymeric sheet, but alternatively, the blank can be formed from a laminate that includes more than one layer. In one embodiment, the blank 3 can include a microwave interactive layer such as is common in MICRORITE® containers available from Graphic Packaging International of Marietta, Ga. The microwave interactive layer can be commonly referred to as, or can have as one of its components, a foil, a microwave shield, or any other term or component that refers to a layer of material suitable for shielding microwave energy and/or causing heating in a microwave oven.

As shown in FIG. 1, the blank 3 has a longitudinal direction L1 and a lateral direction L2, with the side edges 9, 11 extending in the longitudinal direction L1 and the end edges 13, 15 extending in the lateral direction L2. The blank 3 has a central portion 27 (i.e., bottom panel portion or bottom portion), two opposed side portions 29, 31 (i.e., side panel portions or side wall portions), and two opposed end portions 33, 35 (i.e., end panel portions or end wall portions). In one embodiment, four corner portions 37, 39, 41, 43 are between adjacent respective side portions 29, 31 and end portions 33, 35. The blank 3 includes a flange portion 44, which includes a marginal edge portion of the blank that includes the side edges 9, 11, the end edges 13, 15, and the edges of the corners 17, 19, 21, 23. The flange portion 44 extends across the side portions 29, 31, end portions 33, 35 and corner portions 37, 39, 41, 43. Each corner portion 37, 39, 41, 43 comprises a plurality of score lines 49. In the illustrated embodiment, each corner portion 37, 39, 41, 43 comprises ten score lines, but the corner portions could comprise more or less than ten score lines without departing from the disclosure. Further, the blank 3 could be generally circular, with score lines around the entire circumference of the blank without departing from the disclosure. As shown in FIG. 1, the corner portions 37, 39, 41, 43 form a transition area between respective side portions 29, 31 and end portions 33, 35. Accordingly, the side portions 29, 31, the end portions 33, 35, and the corner portions 37, 39, 41, 43 can form a wall portion that extends continuously around the central portion 27 in one embodiment. Further, in one exemplary embodiment, the flange portion 44, which includes the outer edges of the side edges 9, 11, the end edges 13, 15, and the corners 17, 19, 21, 23 can extend continuously around the perimeter of the blank 3.

In one embodiment, the score lines 49 extend across the corner portions 37, 39, 41, 43 and into the flange portion 44 extending around each corner portion. Each score line 49 has an outer end 51 that is spaced apart from a respective outer edge of the corners 17, 19, 21, 23 of the blank, but the score lines could extend to the edge of the blank without departing from the disclosure. Also, in one embodiment, the score lines 49 are formed on the interior surface 12 of the blank 3 such that the score lines 49 comprise slight indentations in the interior surface of the blank. In the illustrated embodiment, each of the score lines terminates at an inner end 53 that approximately corresponds to the transition between the respective corner portions 37, 39, 41, 43 and the bottom portion 27 of the blank. Alternatively, the score lines 49 could extend into the bottom portion 27 without departing from the disclosure. Further, in the illustrated embodiment, the score lines 49 are all approximately the same length, with some of the score lines being in the longitudinal direction L1, some of the score lines being in the lateral direction L2, and some of the score lines being oblique relative to the longitudinal and lateral directions. The score lines could be otherwise shaped, arranged, configured, and/or positioned without departing from the disclosure. For example, the score lines 49 could be of different lengths or could be otherwise positioned at various angles to facilitate forming the container 5 without departing from the disclosure.

FIGS. 2-5 show one embodiment of the disclosure comprising a container 5 formed from the blank 3. The container 5 comprises a bottom wall 103, side walls 105, 107, end walls 109, 111, and corners 113, 115, 117, 119 connecting respective adjacent side walls 105, 107 and end walls 109, 111. In one embodiment, the side walls 105, 107, the end walls 109, 111, and the corners 113, 115, 117, 119 generally form a wall that extends around the container 5. The flange 7 extends outwardly from respective side walls 105, 107, the end walls 109, 111, and the corners 113, 115, 117, 119 (e.g., the flange 7 extends outwardly from the wall of the container 5) and extends continuously around the perimeter of the container 5. The bottom wall 103 is formed from the bottom portion 27 of the blank. In addition, the side walls 105, 107 are formed from respective side portions 29, 31 of the blank, the end walls 109, 111 are formed from respective end portions 33, 35 of the blank, and the corners 113, 115, 117, 119 are formed from the respective corner portions 37, 39, 41, 43 (e.g., the wall of the container 5 is formed from the wall portion of the blank 3). The container 5 has a cavity 127 or interior space that is defined by the bottom wall 103, the side walls 105, 107, the end walls 109, 111, and the corners 113, 115, 117, 119 extending upwardly from the bottom wall 103. In the illustrated embodiment, the side walls 105, 107, the end walls 109, 111, and the corners 113, 115, 117, 119 extend continuously around the cavity 127. The container 5 is for holding and/or cooking and/or heating a food product (not shown) that is placed in the interior space 127 of the container.

Figure 2:
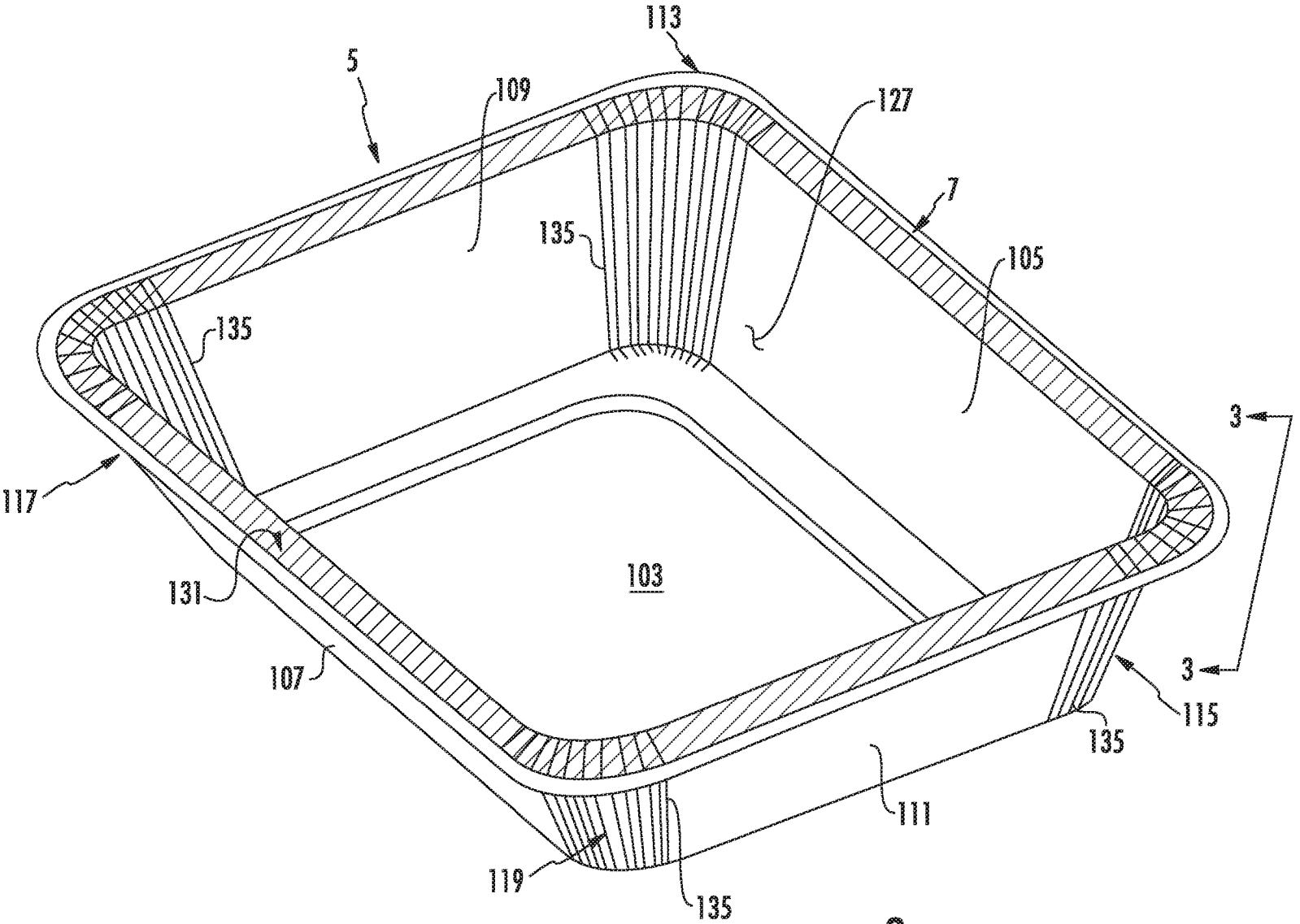
FIG. 2 is a perspective view of the container formed from the blank of FIG. 1.

As shown in FIGS. 1 and 2, the blank 3 and the container 5 include a coating 131 that extends around the perimeter of the blank and the container in the flange region 44 and the flange 7. Alternatively, the coating 131 could be disposed on the portions of the flange region 44 including the score lines 49 (e.g., along and adjacent the corner portions 37, 39, 41, 43) and the portions of the flange region 44 extending along the side portions 29, 31 and end portions 33, 35 that do not include score lines could be free of the coating 131 without departing from the disclosure. As shown in FIGS. 1 and 2, the coating 131 is shown as a cross-hatched area that at least partially covers the flange region 44 and the flange 7, but the coating could be a transparent or translucent film or opaque layer without departing from the disclosure. As shown in the figures, the coating 131 covers a portion of the flange region 44 and the flange 7 and is spaced from the outer edge of the flange. Also, in the illustrated embodiment, the wall of the container 5 is free from contact with the coating 131, and the coating 131 is spaced apart from the bottom wall 103. Alternatively, the coating 131 could cover the entire flange 7 or could cover a different portion of the flange without departing from the disclosure. Further, the coating 131 could extend onto the side walls 105, 107, the end walls 109, 111, the corners 133, 115, 117, 119, and/or other parts of the container 5 without departing from the scope of the disclosure. In one embodiment, the coating 131 can be amorphous polyester, urethane, epoxy, acrylics, another suitable polymer, or any other suitable material.

In one embodiment, the coating 131 can be applied to the material (e.g., web) from which the blank 3 is formed prior to die-cutting the blank 3 from the web of material. Alternatively, the coating 131 could be applied to the blank 3 after it is die cut from the web without departing from the disclosure. In one embodiment, the material selected for the coating 131 is printable and can be applied by screen printing, flexography, die-cutting/appliques, or other suitable application techniques. The coating 131 can have a thickness of approximately 1-2 mils, or the coating could have a thickness that is more or less than approximately 1-2 mils without departing from the disclosure.

Figure 3:
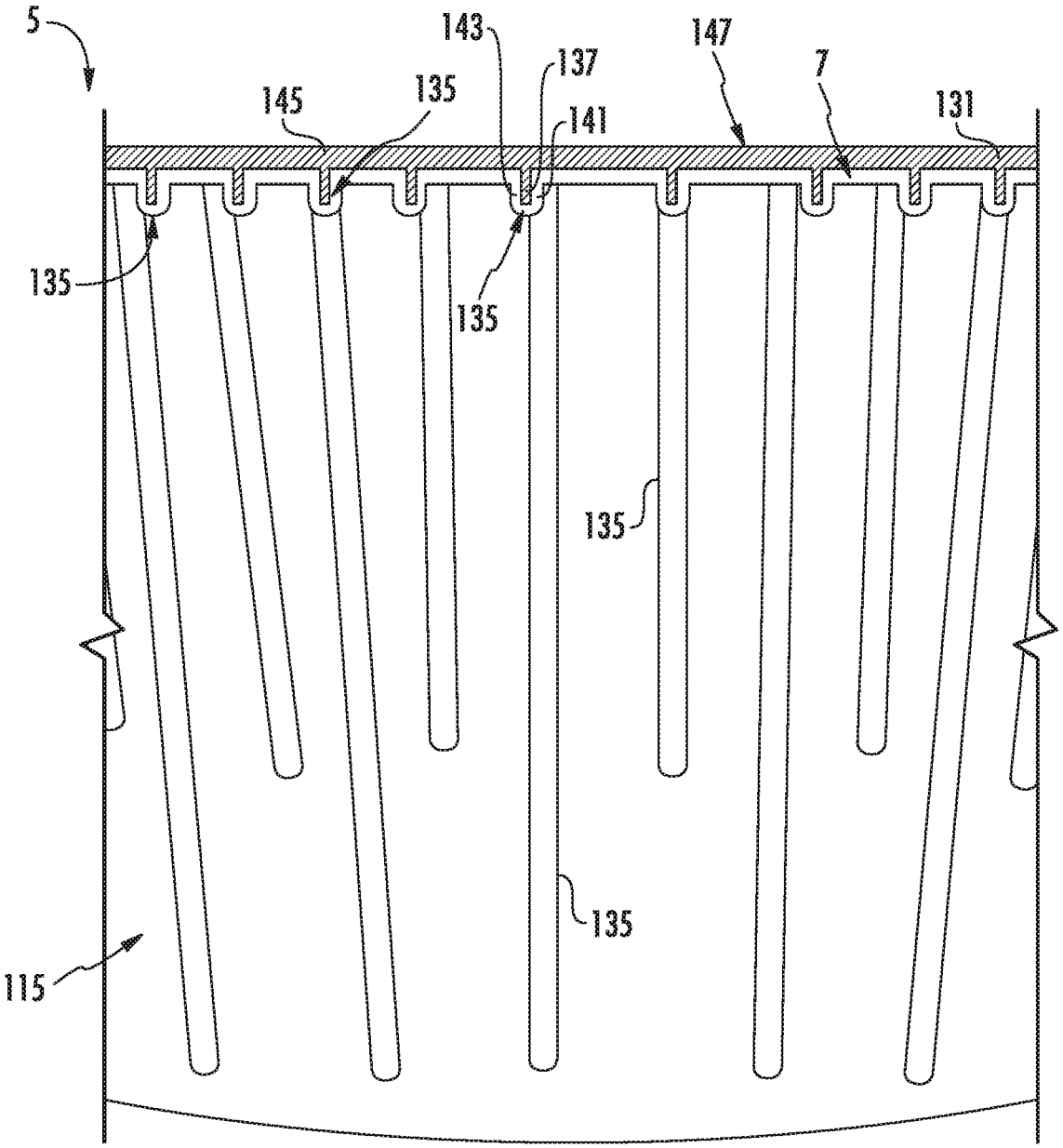
FIG. 3 is a schematic partial elevation view of the container indicated by line 3-3 in FIG. 2 showing a corner of the container and a detail of the flange.
Figure 5:
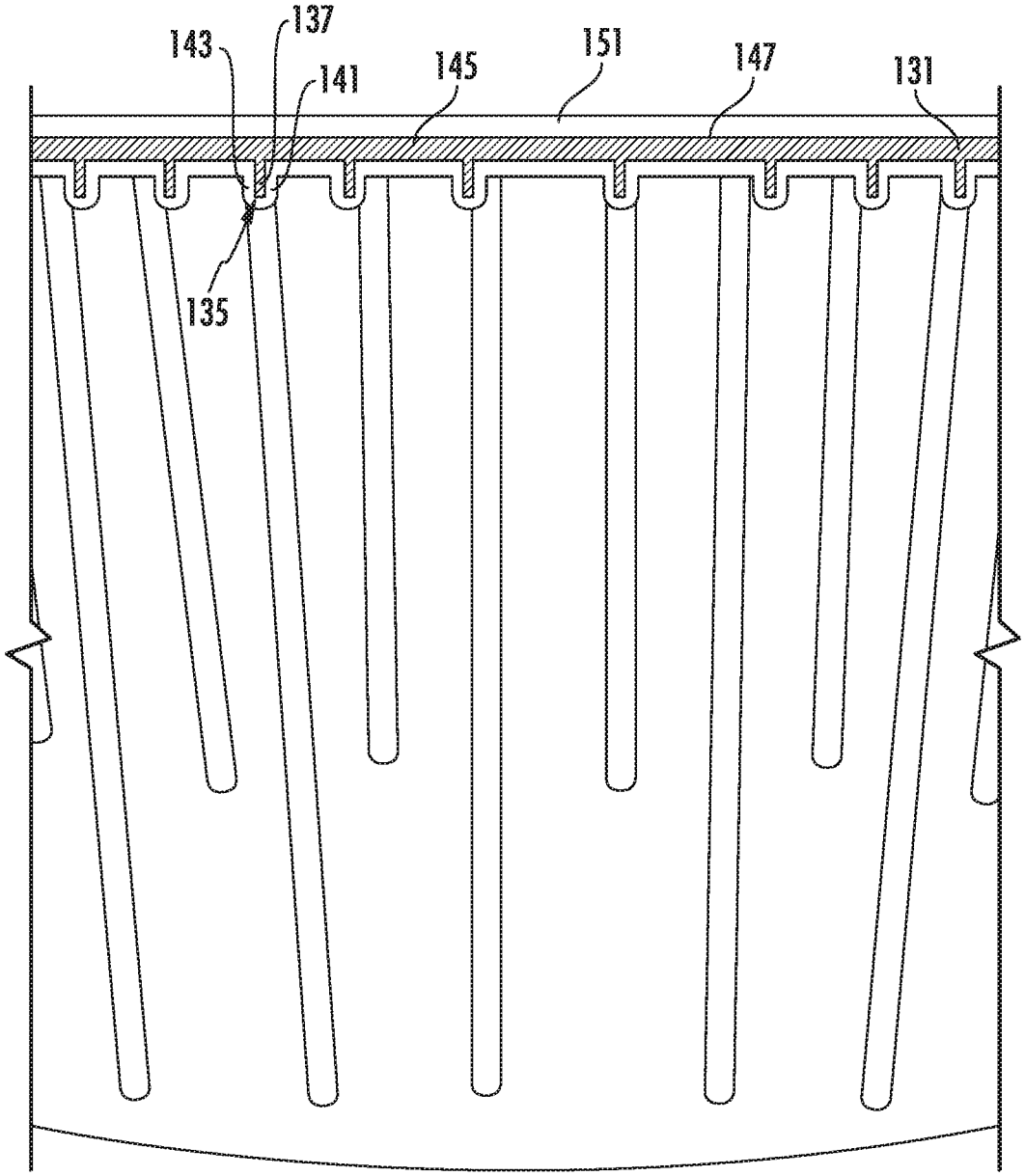
FIG. 5 is a schematic partial elevation view of the container indicated by line 5-5 in FIG. 4 showing a corner of the container and the lid.

In one embodiment, when the blank 3 is press-formed into the container 5 by way of the forming tool T (FIGS. 8 and 9) or other suitable method, the score lines 49 form overlapped portions or pleats 135 (FIGS. 3 and 5). For example, in one embodiment, portions of the blank material can be gathered at the score lines 49 and pressed against the blank (e.g., by the forming tool T) in order to form the pleats 135. The pleats 135 could be otherwise formed without departing from the disclosure. In the illustrated embodiment, the overlapped portions 135 are in the flange 7 of the container 5 and the corners 113, 115, 117, 119, but the overlapped portions 135 could be otherwise arranged in the carton such as in one or more of the side walls 105, 107 and/or end walls 109, 111. As noted above, the tray 5 could be other shapes, such as circular, and the overlapped portions or pleats 135 could extend around the entire perimeter of the tray without departing from the disclosure.

As is schematically shown in FIG. 3, the overlapped portions 135 have a portion 137 of the coating 131 between the two portions of material 141, 143 that form the overlapped portion 135. In one embodiment, when the blank 3 is press-formed into the container 5, the portions of material 141, 143 extending along each of the score lines 49 can fold against one another at the respective score line 49 with a portion 137 of the coating 131 disposed between the portions of material 141, 143. In the schematic of FIG. 3, the pleats 135 are shown as generally symmetric with the portions of material 141, 143 and the portion 137 extending generally downwardly from the flange 7. However, any of the pleats 135 could be symmetric or asymmetric and/or the portions of material 141, 143 could extend in a different direction without departing from the disclosure. For example, the portions of material 141, 143 can be pressed against the flange 7 and/or the wall of the container 5 by the forming tool T as the container 5 is press formed.

Figure 4:
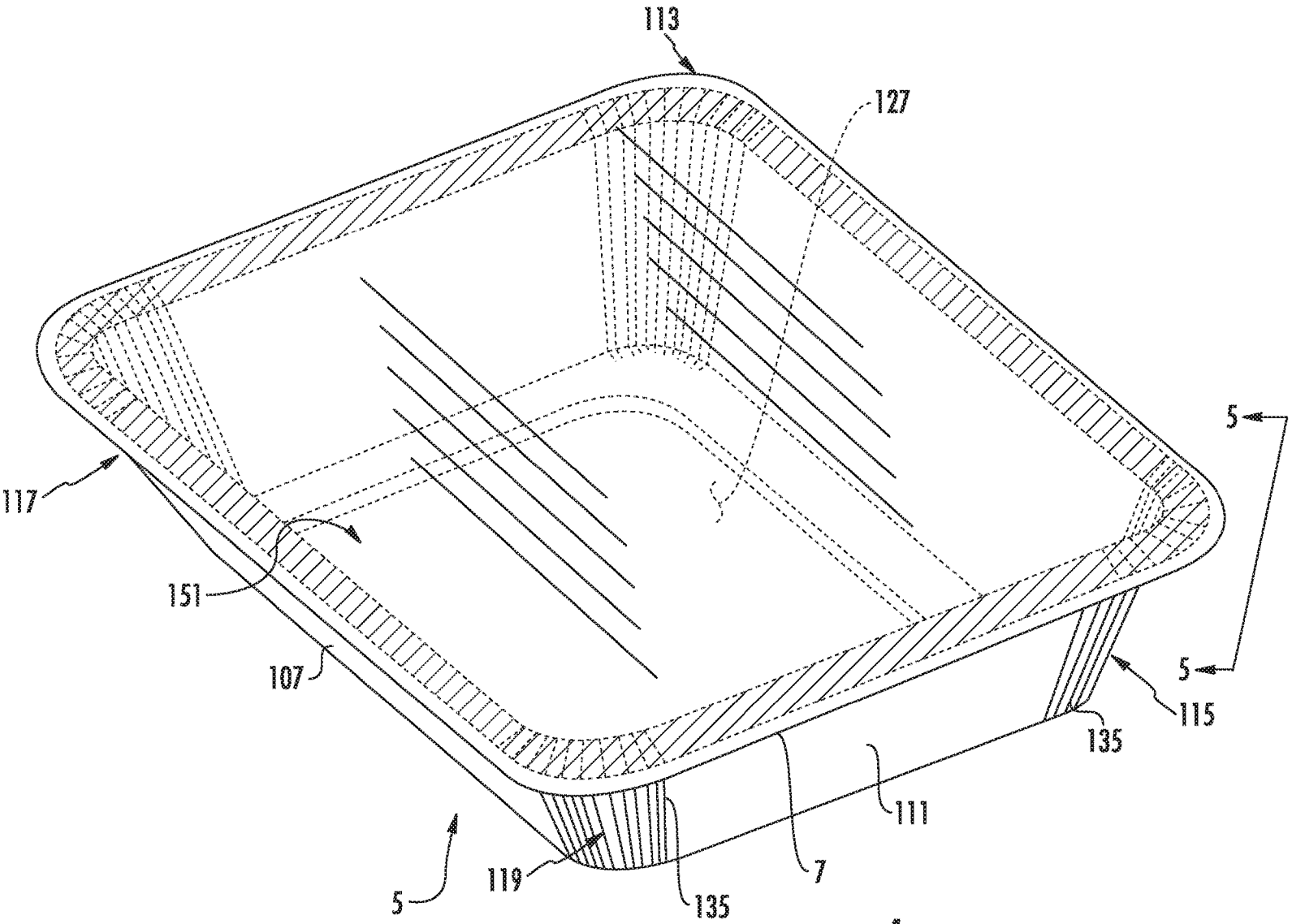
FIG. 4 is a perspective view of the container of FIG. 2 with a lid applied to the flange of the container according to the first embodiment of the disclosure.

Since, as shown in FIG. 3, the coating 131 covers the score lines 49 of the blank 3 before the carton 5 is formed, the coating 131 fills the gap between the portions 141, 143 of material that form the pleats 135. The coating 131 also has a top portion 145 that forms a top surface 147 of the flange 7 that is substantially continuous. In one embodiment, the top surface 147 of the flange 7 is substantially flat, but the top surface may be contoured without departing from the disclosure. The coating 131 covers and seals the pleats 135 to provide a sealing surface 147 of the flange 7 to allow a lid 151 (FIGS. 4 and 5) in the form of a plastic layer or film (e.g., a lidding film) to be attached to the flange 7 to enclose the cavity 127 of the container 5 (FIG. 4). Because the sealing surface 147 is a continuous surface formed by the coating 131, the lid 151 can be sealed or bonded to the flange 7 of the tray 5 to keep the contents of the tray fresh by providing a moisture- and/or air-tight seal between the lid 151 and the sealing surface 147 of the flange 7. The corner 115 of the tray 5 is shown in FIGS. 3 and 5, but the other corners 113, 117, 119 are similarly configured. Also, if additional score lines 49 are provided to form pleats in one or more of the side walls 105, 107 and/or end walls 109, 111, the flange can have a similar configuration as depicted in FIGS. 3 and 5 with the coating 131 filling the gap between the pleats 135 and forming a sealing surface 147 of the flange. In addition, the coating 131 can provide a sealing surface 147 along portions of the flange 7 that do not include pleats. The flange 7 and/or sealing surface 147 could be otherwise shaped, arranged, and/or configured without departing from the disclosure.

In one embodiment, the lid 151 comprises packaging film that is a plastic layer used to preserve and protect a food item contained in the tray. Any plastic film, such as polystyrene, polyethylene, polypropylene, polyethylene terephthalate, polyvinylchloride, polyamide, and ethylene vinyl alcohol, or other suitable material, can be used. In one example, the lidding film is a polystyrene film and the coating 131 comprises amorphous polyester, urethane, epoxy, and/or acrylics. Any other suitable material can be used for forming the lid 151 that is sealed against the sealing surface 147 of the flange 7. In one embodiment, the lid 151 can be sealed against the sealing surface 147 by pressing the lid 151 against the flange 7, heat welding, ultrasonic welding, and/or any other suitable sealing method. Further, adhesives can be used between the lid 151 and the sealing surface 147 without departing from the disclosure.

Figure 6:
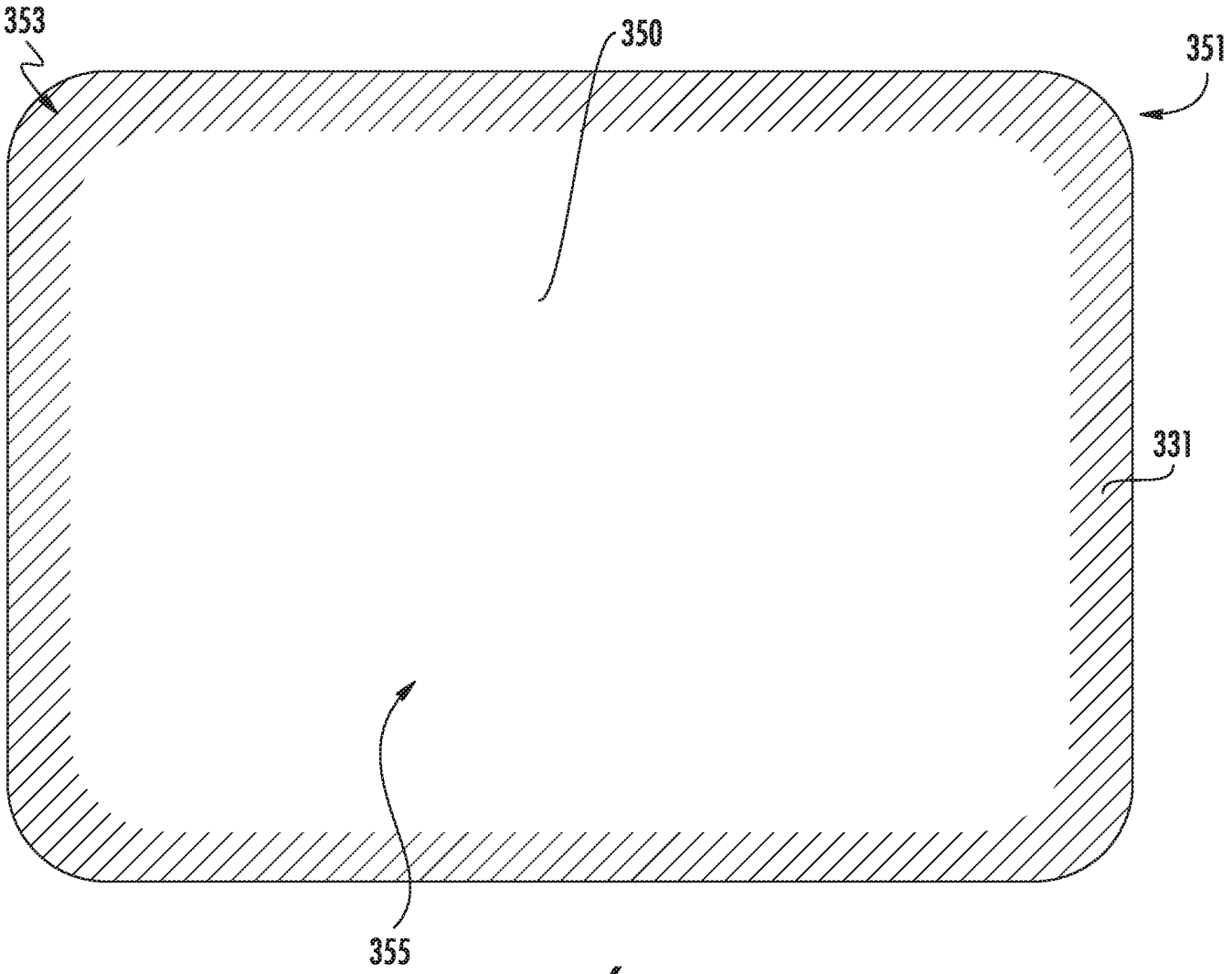
FIG. 6 is a plan view of a lid used for being attached to a container according to a second embodiment of the disclosure.
Figure 7:
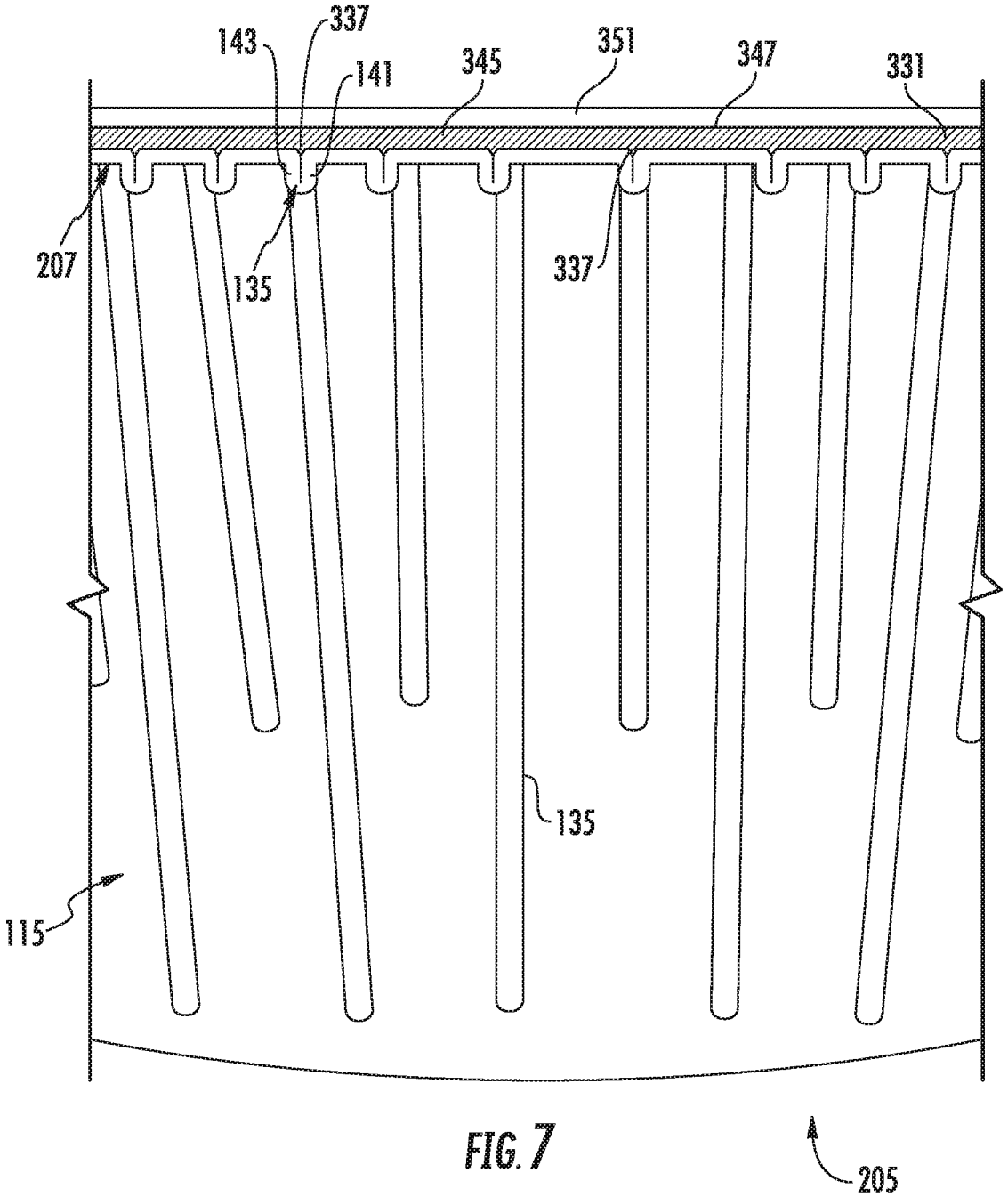
FIG. 7 is a schematic partial elevation view of a corner of a container with the lid of FIG. 6 attached to a flange of the container according to the second embodiment of the disclosure.

FIG. 6 is a plan view of an interior surface 350 of a lid 351 for being attached to a container 205 (FIG. 7) according to an alternative embodiment of the disclosure. The alternative embodiment is generally similar to the first embodiment, except for variations noted and variations that will be apparent to one of ordinary skill in the art. Accordingly, similar or identical features of the embodiments have been given like or similar reference numbers. As shown in FIG. 6, the lid 351 can include a marginal region 353 extending around a central region 355. A coating 331, similar or identical to the coating 131 of the first embodiment, can extend around the perimeter of the lid 351 in at least the marginal region 353 (as shown schematically in FIG. 6 by crosshatching). As shown schematically in FIG. 7, the lid 351 with the coating 331 can be attached to the flange 207 of the carton 205 with the coating 331 therebetween. Accordingly, the coating 331 has an upper portion 345 that can form a substantially continuous surface 347 at the lid 351 and has portions 337 that can at least partially fill in any indentations or other features in the flange 207 at the pleats 135 to help form a moisture- and/or air-tight seal between the lid 351 and the flange 207 around the perimeter of the container 205. Since the container 205 was press-formed without the coating 131 of the first embodiment, the portions 337 might not extend all the way between the portions of material 141, 143 that form the pleats in one embodiment. The lid 351, the coating 331, and/or the container 205 could be shaped, arranged, configured, and/or positioned without departing from the disclosure. For example, the coating 331 could cover more or less of the lid 351 than what is shown in FIG. 6.

Figure 8:
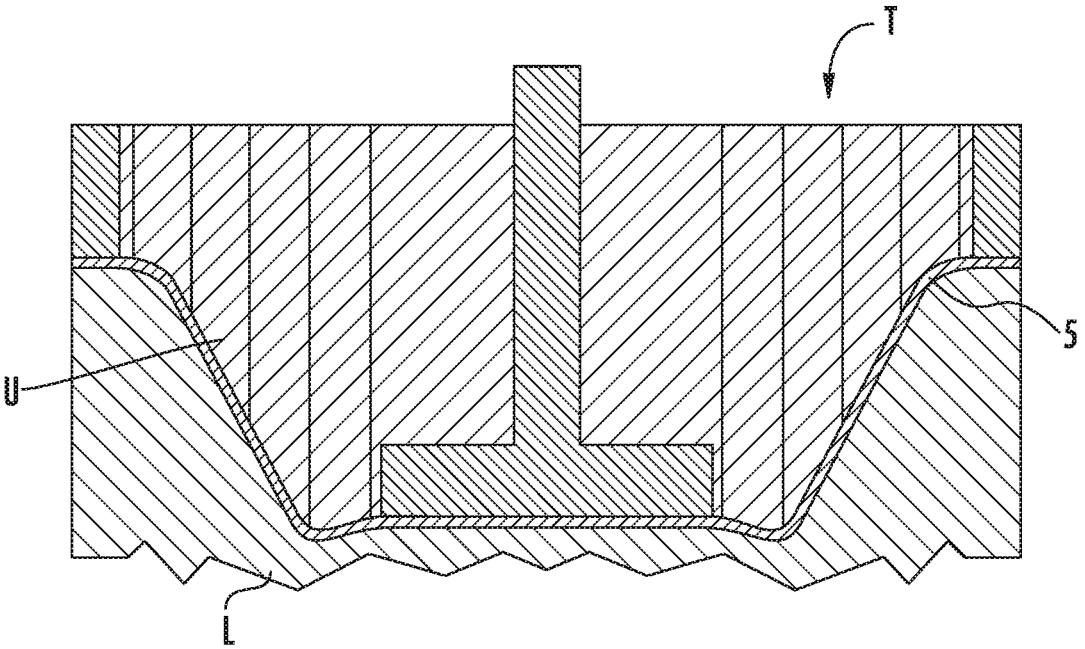
FIGS. 8 and 9 are schematic views of an exemplary forming tool for forming a container according to an exemplary embodiment.
Figure 9:
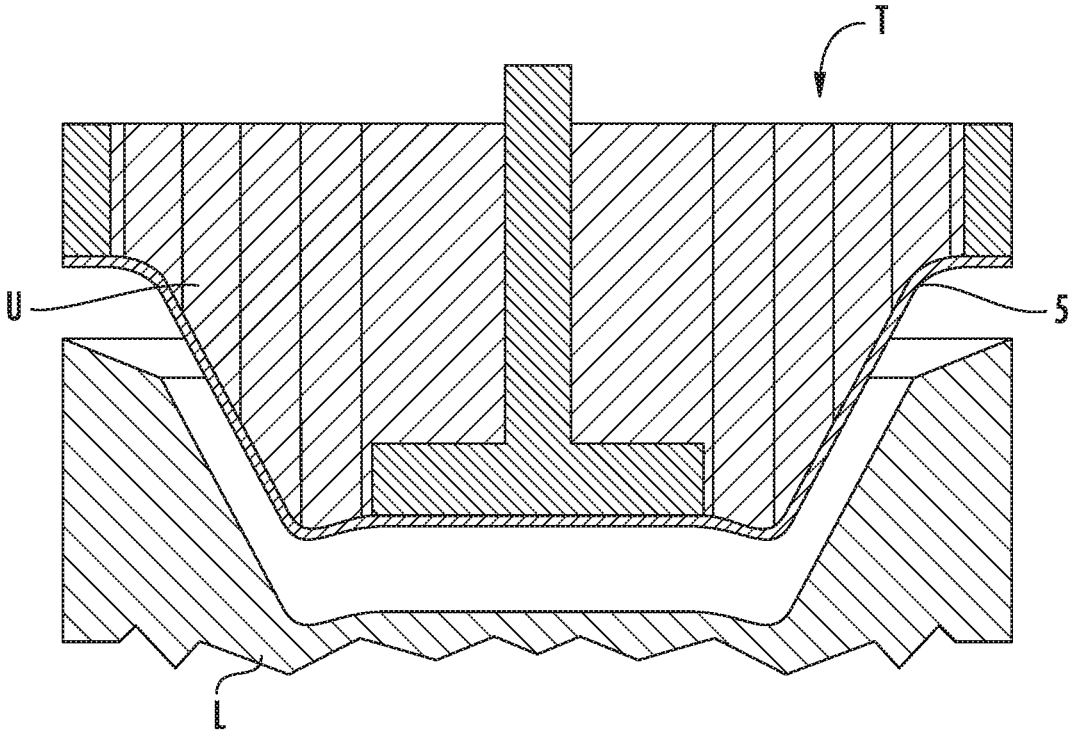

In one embodiment, the blank 3 is formed into the container by conveying a blank and placing the blank in the forming tool T (schematically shown in FIGS. 8 and 9 by way of example) with a lower tool assembly L and upper tool assembly U in a separated or open position. The forming tool T is used to press form the blank 3 into the container 5 by moving the tool assemblies L, U together, to a closed position (FIG. 8, for example). After press-forming the container 5, the tool assemblies L, U can be separated (FIG. 9, for example) to release the container 5. When the flat blank 3 is pressed in the forming tool T, pleats 135 or overlapped portions form at the score lines 49 in the blank. The score lines 49 facilitate forming the flat blank 3 into the three-dimensional container 5 in the forming tool T. The container 5 could be otherwise formed and/or could be formed by any suitable forming tool or forming tools without departing from the disclosure. The forming tool T shown schematically in FIGS. 8 and 9 is included by way of example only.

Any of the features of the various embodiments of the disclosure can be combined with, replaced by, or otherwise configured with other features of other embodiments of the disclosure without departing from the scope of this disclosure. For example, the lid 351 with the coating 331 of the second embodiment can be attached to the flange 7 of the container 5 with the coating 131 of the first embodiment to enclose the cavity 127 of the container 5.

Optionally, one or more portions of the blank or other constructs described herein or contemplated hereby may be coated with varnish, clay, or other materials, either alone or in combination. The coating may then be printed over with product advertising or other information or images. The blanks or other constructs also may be selectively coated and/or printed so that less than the entire surface area of the blank or substantially the entire surface area of the blank may be coated and/or printed.

Any of the blanks, containers, or other constructs of this disclosure may optionally include one or more features that alter the effect of microwave energy during the heating or cooking of a food item that is associated with the tray or other construct. For example, the blank, tray, container, or other construct may be formed at least partially from one or more microwave energy interactive elements (hereinafter sometimes referred to as "microwave interactive elements") that promote heating, browning and/or crisping of a particular area of the food item, shield a particular area of the food item from microwave energy to prevent overcooking thereof, or transmit microwave energy towards or away from a particular area of the food item. Each microwave interactive element comprises one or more microwave energy interactive materials or segments arranged in a particular configuration to absorb microwave energy, transmit microwave energy, reflect microwave energy, or direct microwave energy, as needed or desired for a particular construct and food item.

In the case of a susceptor or shield, the microwave energy interactive material may comprise an electroconductive or semiconductive material, for example, a vacuum deposited metal or metal alloy, or a metallic ink, an organic ink, an inorganic ink, a metallic paste, an organic paste, an inorganic paste, or any combination thereof. Examples of metals and metal alloys that may be suitable include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide, for example, oxides of aluminum, iron, and tin, optionally used in conjunction with an electrically conductive material. Another metal oxide that may be suitable is indium tin oxide (ITO). ITO has a more uniform crystal structure and, therefore, is clear at most coating thicknesses.

Alternatively still, the microwave energy interactive material may comprise a suitable electroconductive, semiconductive, or non-conductive artificial dielectric or ferroelectric. Artificial dielectrics comprise conductive, subdivided material in a polymeric or other suitable matrix or binder, and may include flakes of an electroconductive metal, for example, aluminum.

In other embodiments, the microwave energy interactive material may be carbon-based, for example, as disclosed in U.S. Pat. Nos. 4,943,456, 5,002,826, 5,118,747, and 5,410,135.

In still other embodiments, the microwave energy interactive material may interact with the magnetic portion of the electromagnetic energy in the microwave oven. Correctly chosen materials of this type can self-limit based on the loss of interaction when the Curie temperature of the material is reached. An example of such an interactive coating is described in U.S. Pat. No. 4,283,427.

The use of other microwave energy interactive elements is also contemplated. In one example, the microwave energy interactive element may comprise a foil or high optical density evaporated material having a thickness sufficient to reflect a substantial portion of impinging microwave energy. Such elements typically are formed from a conductive, reflective metal or metal alloy, for example, aluminum, copper, or stainless steel, in the form of a solid "patch" generally having a thickness of from about 0.000285 inches to about 0.005 inches, for example, from about 0.0003 inches to about 0.003 inches. Other such elements may have a thickness of from about 0.00035 inches to about 0.002 inches, for example, 0.0016 inches.

In some cases, microwave energy reflecting (or reflective) elements may be used as shielding elements where the food item is prone to scorching or drying out during heating. In other cases, smaller microwave energy reflecting elements may be used to diffuse or lessen the intensity of microwave energy. One example of a material utilizing such microwave energy reflecting elements is commercially available from Graphic Packaging International, Inc. (Marietta, Ga.) under the trade name MICRORITE® packaging material. In other examples, a plurality of microwave energy reflecting elements may be arranged to form a microwave energy distributing element to direct microwave energy to specific areas of the food item. If desired, the loops may be of a length that causes microwave energy to resonate, thereby enhancing the distribution effect. Microwave energy distributing elements are described in U.S. Pat. Nos. 6,204,492, 6,433,322, 6,552,315, and 6,677,563, each of which is incorporated by reference in its entirety.

If desired, any of the numerous microwave energy interactive elements described herein or contemplated hereby may be substantially continuous, that is, without substantial breaks or interruptions, or may be discontinuous, for example, by including one or more breaks or apertures that transmit microwave energy. The breaks or apertures may extend through the entire structure, or only through one or more layers. The number, shape, size, and positioning of such breaks or apertures may vary for a particular application depending on the type of construct being formed, the food item to be heated therein or thereon, the desired degree of heating, browning, and/or crisping, whether direct exposure to microwave energy is needed or desired to attain uniform heating of the food item, the need for regulating the change in temperature of the food item through direct heating, and whether and to what extent there is a need for venting.

By way of illustration, a microwave energy interactive element may include one or more transparent areas to effect dielectric heating of the food item. However, where the microwave energy interactive element comprises a susceptor, such apertures decrease the total microwave energy interactive area, and therefore, decrease the amount of microwave energy interactive material available for heating, browning, and/or crisping the surface of the food item. Thus, the relative amounts of microwave energy interactive areas and microwave energy transparent areas may be balanced to attain the desired overall heating characteristics for the particular food item.

As another example, one or more portions of a susceptor may be designed to be microwave energy inactive to ensure that the microwave energy is focused efficiently on the areas to be heated, browned, and/or crisped, rather than being lost to portions of the food item not intended to be browned and/or crisped or to the heating environment. Additionally or alternatively, it may be beneficial to create one or more discontinuities or inactive regions to prevent overheating or charring of the food item and/or the construct including the susceptor.

As still another example, a susceptor may incorporate one or more "fuse" elements that limit the propagation of cracks in the susceptor, and thereby control overheating, in areas of the susceptor where heat transfer to the food is low and the susceptor might tend to become too hot. The size and shape of the fuses may be varied as needed. Examples of susceptors including such fuses are provided, for example, in U.S. Pat. Nos. 5,412,187, 5,530,231, U.S. Patent Application Publication No. US 2008/0035634A1, published Feb. 14, 2008, and PCT Application Publication No. WO 2007/127371, published Nov. 8, 2007, each of which is incorporated by reference herein in its entirety.

All dimensional information presented herein is intended to be illustrative of certain aspects, features, etc., of various embodiments of the disclosure, and is not intended to limit the scope of the disclosure. The dimensions of the blanks, containers, forming tools, features, or any other dimension, can be more or less than what is shown and described in this disclosure without departing from the scope of this disclosure and can be within the listed ranges of dimensions for each feature or outside the listed ranges of dimensions for each feature without departing from the scope of this disclosure.

The blanks according to the present invention can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blanks. The blanks may also be coated with, for example, a moisture barrier layer, on either or both sides of the blanks.

In accordance with the exemplary embodiments, the blanks may be constructed of paperboard of a caliper such that it is heavier and more rigid than ordinary paper. The blanks can also be constructed of other materials, such as cardboard, hard paper, or any other material having properties suitable for enabling the carton package to function at least generally as described above.

The foregoing description illustrates and describes various embodiments of the present disclosure. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, and alterations, etc., of the above-described embodiments. Additionally, the disclosure shows and describes only selected embodiments, but various other combinations, modifications, and environments are contemplated and are within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments without departing from the scope of the disclosure.

What is claimed is:

1. A method of forming a container from a blank, the method comprising:

obtaining a blank having a wall portion, a flange portion, and a coating having a thickness of 1 mil to 2 mils on at least a portion of the flange portion, at least one score line extending at least partially in the flange portion, and the coating at least partially covering the at least one score line;

forming the container from the blank by forming a wall of the container from the wall portion and forming a flange of the container from the flange portion, the flange extending from the wall, wherein the forming the container further comprises forming the at least one score line into at least one pleat in at least the flange, and the coating at least partially covers the at least one pleat to form a substantially continuous sealing surface of the container on the flange.

2. The method of claim 1, wherein at least a first portion of material and a second portion of material extend along the at least one score line, and the forming the at least one score line into the at least one pleat comprises at least partially overlapping the first portion of material and the second portion of material so that a portion of the coating extends between the first portion of material and the second portion of material in the at least one pleat.

3. The method of claim 1, wherein the forming the wall comprises forming an end wall connected to a side wall via a corner, the forming the flange comprises positioning the flange to extend outwardly from the side wall, the corner, and the end wall, and the at least one pleat extends in at least the flange at the corner.

4. The method of claim 3, wherein at least a portion of each of the side wall, the end wall, and the corner is free from contact with the coating.

5. The method of claim 3, wherein the at least one score line comprises a plurality of score lines, the forming the at least one pleat comprises forming a plurality of pleats from the plurality of score lines so that the plurality of pleats extend in at least the flange at the corner, and the coating at least partially covers each pleat of the plurality of pleats.

6. The method of claim 3, wherein the blank further comprises a bottom portion, the wall portion extends along the bottom portion, the forming the container from the blank further comprises forming a bottom wall from the bottom portion, the bottom wall is connected to each of the side wall, the end wall, and the corner, and the coating is spaced apart from the bottom portion in the blank and the bottom wall in the container.

7. The method of claim 1, wherein the forming the container from the blank further comprises forming a cavity of the container so that the wall extends around the cavity, the flange extends outwardly from the wall and along the perimeter of the container, and the coating extends along the cavity of the container on the flange.

8. The method of claim 7, wherein at least a portion of the wall is free from contact with the coating.

9. The method of claim 7, wherein the blank further comprises a bottom portion, the wall portion extends along the bottom portion, the forming the container from the blank further comprises forming a bottom wall from the bottom portion, and the bottom wall is connected to the wall, the coating being spaced apart from the bottom portion in the blank and the bottom wall in the container.

10. The method of claim 1, wherein the forming the container from the blank comprises press forming the blank into the container.

11. The method of claim 1, further comprising attaching a lid to the flange at the sealing surface.

12. The method of claim 11, wherein the lid comprises polystyrene and the coating comprises a material selected from the group consisting of amorphous polyester, urethane, epoxy, and acrylics.

13. The method of claim 1, wherein the coating comprises a material selected from the group consisting of amorphous polyester, urethane, epoxy, and acrylics.

14. The method of claim 1, wherein the forming the flange comprises disposing the flange to extend outwardly from the wall to a perimeter of the container, and the coating on the flange is spaced apart from the perimeter of the container.

15. The method of claim 14, wherein the coating extends on a top surface of the flange along an upper end of the wall.

16. The method of claim 1, wherein the blank further comprises a bottom portion, the wall portion extends along the bottom portion, the forming the container from the blank further comprises forming a bottom wall from the bottom portion and forming a cavity so that the bottom wall and the wall extend along the cavity, the coating extends on a portion of the wall along the cavity of the container, and the coating is spaced apart from the bottom wall.

17. A method comprising:

obtaining a blank comprising at least one score line, wherein a coating having a thickness of 1 mil to 2 mils is disposed along a portion of the blank, and the coating at least partially covers the at least one score line; and forming a container from the blank by press forming the blank into at least a wall and a flange extending outwardly from the wall, wherein the forming the container from the blank further comprises forming the at least one score line into at least one pleat in at least the flange, and the coating at least partially covers the at least one pleat to form a substantially continuous sealing surface of the container on the flange.

18. The method of claim 17, wherein at least a first portion of material and a second portion of material extend along the at least one score line, and the forming the at least one score line into the at least one pleat comprises at least partially overlapping the first portion of material and the second portion of material so that a portion of the coating extends between the first portion of material and the second portion of material in the at least one pleat.

19. The method of claim 17, wherein the at least one score line comprises a plurality of score lines, the forming the at least one pleat comprises forming a plurality of pleats from the plurality of score lines so that the plurality of pleats extend in at least the flange and the coating at least partially covers each pleat of the plurality of pleats to form the substantially continuous sealing surface of the container on the flange.

20. The method of claim 17, wherein at least a portion of the wall is free from contact with the coating.

21. The method of claim 17, further comprising attaching a lid to the flange at the sealing surface after the forming the container.

22. The method of claim 17, wherein the coating is spaced apart from a perimeter of the blank.

23. The method of claim 17, wherein the blank comprises a bottom portion and the coating is spaced apart from the bottom portion in the blank.

* * * * *